US006494410B2

(12) United States Patent
Lenz

(10) Patent No.: US 6,494,410 B2
(45) Date of Patent: Dec. 17, 2002

(54) DIGITAL MULTI-TRAIN CONTROL WITH BI-DIRECTIONAL DATA TRANSMISSION IN MODEL RAILWAYS

(76) Inventor: Bernd Lenz, Hüttenbergstrasse 47, Giessen-Allendorf (DE), D-35398

( * ) Notice: Subject to any disclaimer, the term of this patent is extended or adjusted under 35 U.S.C. 154(b) by 0 days.

(21) Appl. No.: 09/800,880

(22) Filed: Mar. 7, 2001

(65) Prior Publication Data

US 2001/0020430 A1 Sep. 13, 2001

(30) Foreign Application Priority Data

Mar. 11, 2000 (DE) ..... 100 11 978

(51) Int. Cl.[7] ..... B61L 23/34
(52) U.S. Cl. ..... 246/122 A
(58) Field of Search ..... 246/122, 122 A

(56) References Cited

U.S. PATENT DOCUMENTS 4,027,840 A * 6/1977 Blair ..... 246/122
4,151,969 A * 5/1979 Wood ..... 246/122
6,220,552 B1 * 4/2001 Ireland ..... 246/122

FOREIGN PATENT DOCUMENTS

DE 39 27 651 A1 3/1991 ..... A36H/19/24
EP 90 114 121 10/1994 ..... A36H/19/24

OTHER PUBLICATIONS

Zimo Proposal to NMRA for Signal Controlled Speed Influence and Loco Number Identification, Zimo Elektronik, Mar. 20, 1998.

Renewed Proposal for Signal Controlled Speed Influence and Train Number Identification for NMRA–DCC protocol, ZIMO Elektronik, Oct. 1996.

Digital Command Control: Tentative Recommended Practice Pending 1994 Ballot on DCC Standard 9.2, NMRA Electrical Committee: Command Control Working Group, Aug. 2, 1994.

RP–9.2.3. Service Mode Recommended Practice, NMRA, May 15, 1995.

* cited by examiner

*Primary Examiner*—S. Joseph Morano
*Assistant Examiner*—Robert J. McCarry, Jr.
(74) *Attorney, Agent, or Firm*—Quarles & Brady LLP

(57) ABSTRACT

A method and device which digitally controls moveable and/or stationary electrical consumers in a model railway. The power for the consumers is supplied over the track in the form of a square wave voltage signal which is frequency and/or pulse width modulated according to digital control information for the consumers generated by a central control unit of the model railway. A consumer, after having received a control information addressed to said consumer, applies a return signal to the track, which return signal has a higher frequency than the frequency of the modulated square wave voltage. This return signal is detected by synchronising the detection to the square wave voltage such that the return signal is detected in periods of the square wave voltage signal which are free of signal edges.

22 Claims, 7 Drawing Sheets

| | Duration 1. Half | Duration 2. Half | Total duration |
|---|---|---|---|
| "1"-Bit | 55µs < t < 61µs | 55µs < t < 61µs | nominally 116µs |
| "0"-Bit | nominally 100µs | nominally 100µs | typically 200µs |
| Stretched "0"-Bit | nominally 100µs | max. 9900µs | t <= 12000µs |

Example packet for the transmission of data to a consumer

| | Duration 1. Half | Duration 2. Half | Total duration |
|---|---|---|---|
| "1"-Bit | 55µs < t < 61µs | 55µs < t < 61µs | nominally 116µs |
| "0"-Bit | nominally 100µs | nominally 100µs | typically 200µs |
| Stretched "0"-Bit | nominally 100µs | max. 9900µs | t <= 12000µs |

Example packet for the transmission of data to a consumer

DIGITAL MULTI-TRAIN CONTROL WITH BI-DIRECTIONAL DATA TRANSMISSION IN MODEL RAILWAYS

CROSS REFERENCES TO RELATED APPLICATION

This application claims priority to German Patent Application 100 11 978.6 filed on Mar. 11, 2000.

STATEMENT REGARDING FEDERALLY SPONSORED RESEARCH

Not Applicable

BACKGROUND OF THE INVENTION

In digital controls for model railways, digital information and, at the same time, the power supply voltage are transmitted via the same connection line, namely the track, from a central control unit to various individual electrical consumers. The control unit modulates the power supply voltage with a control signal for a decoder in each consumer. Moveable electrical consumers in the form of locomotives thus receive an address, a desired speed, actuating, switch and control information, or the like, as digital information. The decoders in the consumers which serve as receiving means for the digital information decode the control signals and control a motor or switching devices with the energy which is also transmitted via the track.

In the case of a stationary decoder, the same principle applies. In this case, a fixed wiring is used which is connected to the track. Stationary consumers are, for example, turnouts which are supplied with power, as well as, with control signals using the track voltage, and which are provided with an appropriate decoder for decoding the control signals.

This type of voltage transmission for the purpose of power supply as well as control, has always been unidirectional from the control unit to the consumer. Contact via the track, as is known, is subject to possible bad track contacts, bogeys, wheels, bad contact at turnouts and the like. The switching processes and transients in the decoders, as well as the wave form of the combined control and track supply signal itself can cause great interference and distortions with corresponding harmonics. As a result of these circumstances, the decoder in a locomotive might not receive the control signal at all, and on the other hand, a received control signal could be so distorted so that it can not be decoded correctly.

SUMMARY OF THE INVENTION

An object of the invention is to provide a method and device for the digital control of moveable and stationary electrical consumers of a model railway, which provide a more reliable control with limited technical effort while allowing for the relevant control norms and standards.

This object is solved by the subject matter of the independent claims. Further advantageous developments are defined in the subclaims. The invention as claimed provides a digital multi-train control with bidirectional data transmission between the consumers and the model railway's central control unit. The bidirectional data transmission enables information to be sent from the consumer which information in the simplest case, represents an acknowledgement or receipt of the transmission of control information.

According to the main object of the invention there is provided a method for digital control of electrical consumers in a model railway wherein power for the consumers is supplied over the track in form of a square wave voltage signal which is frequency and/or pulse width modulated according to digital control information for the consumers generated by a central control unit of the model railway, and wherein a consumer, after having received a control information specifically addressed to said consumer, applies a return signal to the track, which return signal has a higher frequency than the frequency of the modulated square wave voltage, and wherein this return signal is detected by synchronising the detection to the square wave voltage such that the return signal is detected in periods of the square wave voltage signal which are free of signal edges. The consumers can be moveable and/or stationary electrical consumers.

A fundamental problem is solved in the invention. It is, in principle, very difficult to return or feed back a data signal from the decoder of a consumer to a control unit via the same transmission path as the track power supply. This is due to the above mentioned signal distortion within this transmission path and the resulting strong interference effects and distortions in the signal to be returned or fed back to the control unit. It is likewise very difficult to successfully decode the returned data, for example, in the form of an acknowledgement or receipt of a control signal. On the one hand, the control signal from the control unit, which is superimposed on the power supply voltage as frequency modulation or pulse width modulation in a predefined manner, is always transmitted and present, and must not by affected by the return signal. On the other hand, the strong control signal modulation in the track signal presents a problem for decoding the signal to be returned. Moreover, this is made even more difficult by the fact that particularly the decoder of the moveable consumer must be small sized due to its predefined constructional design in the consumer. Therefore, providing any substantial additional signal generating and transmitting equipment is ruled out.

The inventional solution succeeds in superimposing a return signal to be sent or retransmitted to the control unit on the track signal by means of little additional technical features within a decoder which have to be provided to implement this superimposing. Furthermore, the generated return signal can be produced reliably and with little technical effort. A decisive feature here is that the signal is generated and detected in synchronized manner to the modulated track signal such that the return signal can only be detected in signal periods of the track signal which do not comprise signal edges, and, in other words, in signal periods or signal intervals between alternating polarities.

Preferably, the time sections of the modulated track signal being used for superimposing the return signal are time sections in which the voltage level of the digital track signal does not change. Preferably, these sections correspond with the second signal half of a zero information in the digital track signal, as shown below. These periods are detected by the decoder's evaluator means when detecting the digital track signal anyway, so that a corresponding control or trigger signal can be derived from the evaluator unit for generating the return signal without extra effort.

The return or feedback signal itself is a high frequency signal whose frequency is considerably higher than the modulation frequency of the track signal. Such a high frequency signal can be detected reliably in the above mentioned signal edge free periods between alternating polarities of the track signal. The criteria for this are explained below referring to the disclosed examples. The signal form of the return signal to be superimposed on the track signal is not restricted to specific wave forms. For example, the digital track signal can be superimposed with a 1 MHz oscillation generated by an oscillator. Preferably, a cost-effective and space-saving current modulation is used rather than a voltage coupling by means of an oscillating circuit or capacitors.

In principle, the high frequency return signal can also be coupled into signal sections of the track signal which are not free of signal edges by the consumer, since, as recited in claim 1, upon receipt of the return signal, the signal periods which comprise signal edges are cut off In this way, the oscillating circuits or the active filters of high quality in the detection means for the return signal, which are tuned to the return signal's frequency, remain unaffected by the control signal edges of the square wave track signal. However, it is advantageous when the return signal is exclusively generated in the predefined edge free periods of the track signal. Thereby, the lost power is kept to a minimum.

An addressed consumer, to which control information is sent or transmitted in a track voltage data packet cannot only acknowledge the receipt of the control information by generating the return signal intermittently or continuously and preferably in the next data packet. The consumer can even send more information in several of the periods between signal edged or alternating polarities available in the next data packet, as explained in detail below.

The next data packet is preferably used for transmitting the return signal because this guarantees that the return signal is clearly allocated to the returning consumer which was addressed in the previous packet so that a separate address in the return signal is not necessary to identify the returning consumer which generated the return signal.

As a result of the receipt message provided by the return signal, the control through the central control unit becomes more secure against the above mentioned influence by signal interference and distortion. Multiple transmissions of the same control information for one consumer can be avoided. Hence, lots of control information for a number of consumers can be managed, thereby increasing the transmission bandwidth of the control unit. As a result of the bidirectional communication according to the invention, it is also possible to transmit consumer data to the central control unit via the track, alongside the transmission of supply energy and control information, at the same time as transmitting control information to the consumers.

In addition, the invention offers a simple way to localize moveable consumers on the model railway. For this purpose, the track is subdivided into several sections, with an evaluation unit allocated to each section.

The invention has been implemented for data transmission in the NMRA DCC Electrical Standard and NMRA DCC Communication Standard, however, it can also be used for other forms of digital transmission of information from a control unit to a consumer in a digital model railway if energy is simultaneously supplied via the same wiring or transmission means as the control information. For example, this is the case for standards with pulse width or pulse length modulation instead of the frequency modulation used in the preferred embodiment. Typically, regardless of the standard, an information packet sent to a consumer contains its address so that the data's addressee is clearly defined. The invention, however, could also be used in principle with a control system where a fixed number of possible consumers receive information in a prescribed addressing cycle.

An evaluation means for the return signal from the consumer can, for example, be integrated into a power amplifier or into the control unit on the railway, or can be provided as an independent additional device. The evaluation means synchronizes the data from the return signal which the consumer sends by detecting and evaluating the return signal together with the track signal which the control unit transmits. As a result of this, the synchronisation of the consumer's return signal is achieved. Synchronisation can also be achieved by sending a specific synchronisation signal from the control unit directly to the evaluation means. In this way, the answer from a specific consumer can be triggered.

Furthermore, in principle, it is also possible to implement the invention by generating a constant additional high frequency signal in the track signal corresponding to the frequency of the above return signal and, instead of generating the return signal, a "returning" consumer would temporarily damp or suppress this continuous high frequency signal. For detecting such a signal suppression, the evaluation means can also comprise a sender or transmitter which constantly modulates a sender frequency, e.g. 1 MHz, on the track voltage and which monitors the amplitude of the modulated voltage. Synchronisation of the return signal can be realized as described above. A consumer which transmits a return signal to the evaluation unit loads the track voltage during the predefined transmitting or sending periods by lowering its impedance at 1 MHz. The evaluation unit detects the resulting amplitude decrease and recognizes a return signal. Thereby, a binary transmission of information from the consumer to the control unit is also possible by means of repeated load and non-load actions effected in the preferred predefined time periods.

These and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE PREFERRED EMBODIMENT

Figure 1:
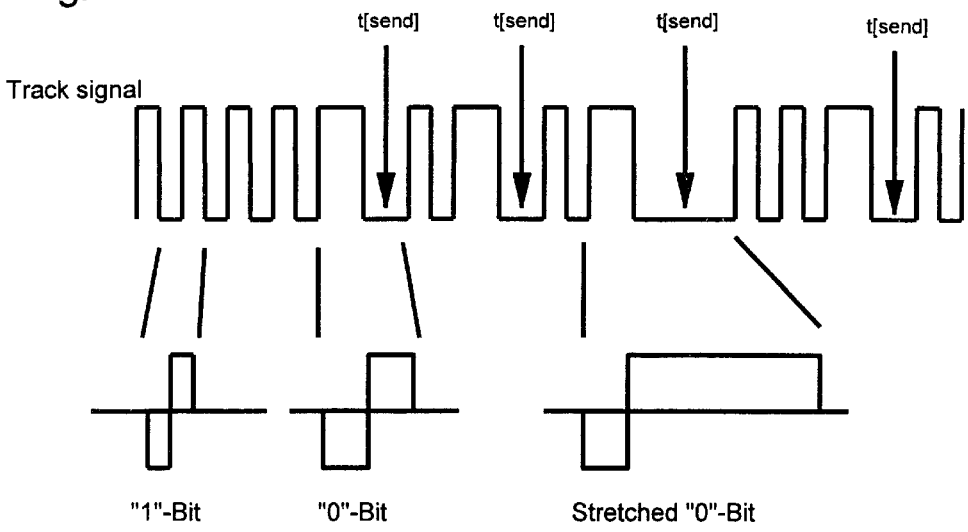
FIG. 1 shows the coding of bits with a track voltage format according to the NMRA standard, with possible time periods for a return signal according to an embodiment of the inventional method.
Figure 2:
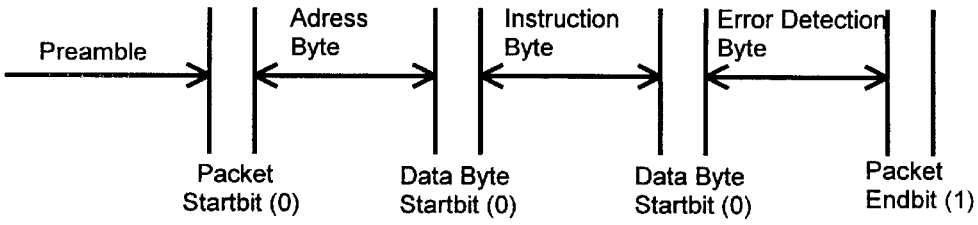
FIG. 2 shows a data packet with a track voltage format according to the NMRA standard.
Figure 3:
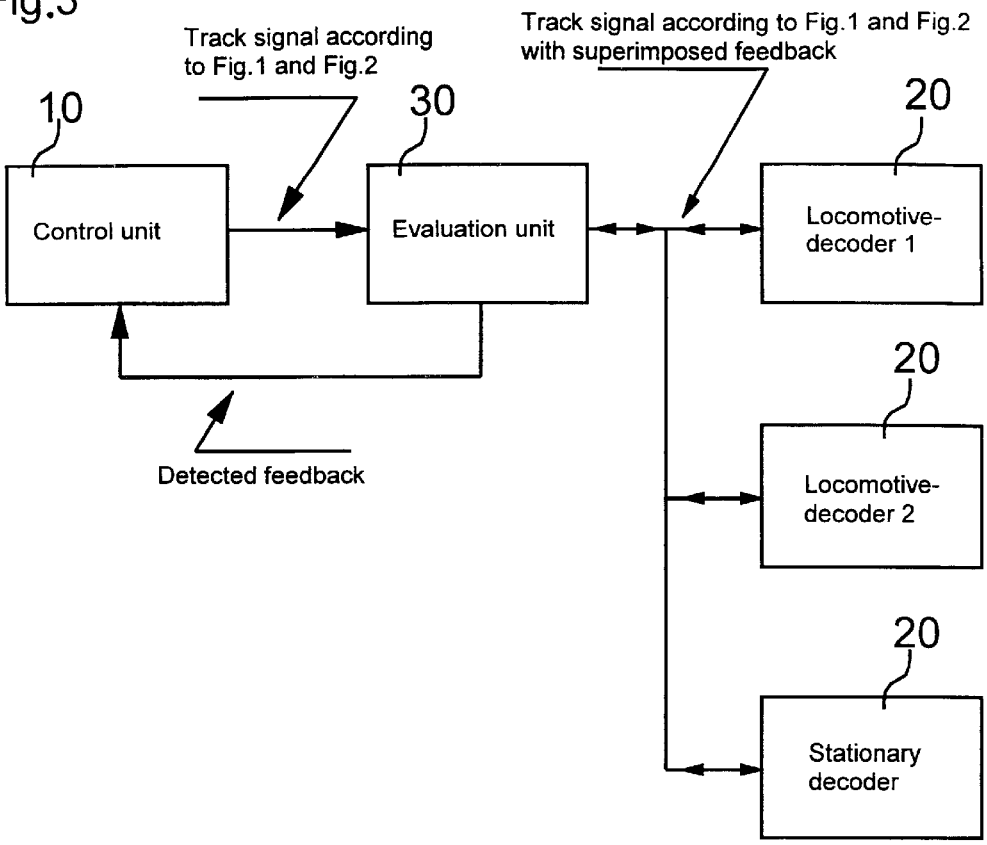
FIG. 3 shows a schematic diagram to explain the principle of the invention.

When transmitting digital information according to the NMRA standard from a control unit 10 to a decoder or consumer 20 (locomotive decoder or stationary decoder according to FIG. 3), the schemata in FIG. 1 is used to code the bit values 0 and 1 in which possible time points t[send] for return signals according to the invention are indicated. A data packet transmitted in that manner is shown in FIG. 2. The preamble is a header for a data packet and consists of a sequence of at least ten "1" bits. The packet start bit is the first "0" bit which follows the preamble. It concludes the preamble and signals that the next bits represent an address byte. After transmission of the address byte, there is another "0" bit as indication for a following data byte in the form of a data byte start bit. The error detection byte serves to recognize transmission errors. The packet end bit at the end of a data byte denotes the end of the data packet and generally belongs to the preamble of the following packet.

In the example, the evaluation unit 30 receives the track signal shown in FIGS. 1 and 2 from the control unit 10. The consumer 20 constantly detects and evaluates the track signal in a principally known manner and evaluates and carries out the control information contained in the data packets addressed to it. In this way, both the evaluation means 30 and the consumer 20 can use the square wave in the track to trigger and time the generation and detection of the return signal. The evaluation unit 30 supplies the return of feed-back information in the track signal detected by it to the central control unit 10 for further processing.

FIG. 2 shows a possible return or feed-back transmission of a byte according to the track format in FIG. 1. If a consumer 20 has fully received a data packet addressed to it, this consumer can feed back information via the evaluation unit 30 to the control unit 10 in the following data packet. For this purpose, the consumer 20 modulates the above mentioned higher frequency on the data packet, which the evaluation means 30 then demodulates again and in thereby detects a bit information of the return or feed-back signal.

In the present example, a frequency of 1 MHz is used for the return signal which is far higher than the frequency of the track signal of 5 to 10 kHz. Moreover, the return signal according to FIG. 1 is sent during the second signal half of a zero information ("0" bit), since during this period, the digital track signal modulated by the control unit for a longer period of time does not exhibit a change in signal level, whose signal edges could lead to incorrect evaluation. By means of this triggering when producing the return signal and particularly when detecting the return signal, the signal distortions and interference present in the track signal itself are eliminated and inhibited from reaching the detection oscillating circuits, detection filters and detection counters in the evaluation means, which are sensitively tuned to the 1 MHz return signal.

The available signal edge free periods between alternating polarities in the form of the second half of the zero information is long enough, compared to the short periods of the return signal, so that the return of feedback signal can reliably be detected in oscillating circuits used in the evaluation means 30. The oscillating circuits have enough time to oscillate to the main frequency and to detect the bit value 1 which represents a return signal according to the present embodiment. The bit value 0 represents that the transmission frequency of the sender frequency in the consumer's return signal is not present. Besides, another allocation of the detection and nondetection of the return signal to the bit values 0 or 1 can be freely set. In order to achieve the highest quality, the NMRA track format has the possibility to introduce stretched "0" bits as indicated in FIG. 1. Thereby, the period of the second zero bit half can even be lengthened.

In order to implement the described method, it is necessary that all consumers which momentarily do not send a return signal have a high impedance for the selected transmission frequency (here, for 1 MHz). Depending upon the detection means in the evaluation means, it is also possible to select considerably lower frequencies, for example, down to 300 kHz or even lower, for the return signal. In this case hardware expenditure may be higher and it might be necessary to lengthen the signal edge free periods between alternating polarities being used for transmission and detection of the return signal. Alternatively, frequencies higher than 1 MHz are also possible for the return signal.

The track signal format in FIGS. 1 and 2 shows at least eleven zero bits due to the use of the error correction byte in a valid data packet. Thus it is possible to transmit from the consumer more than only 1-bit information as a return signal which, in the simplest case, represents confirmation of receipt of the control signal. Allowing for the synchronisation bit, at least ten data bits can be transmitted in the return signal to the control unit. Of these, only eight bits corresponding to one byte are suitably used. Therefore, it is possible, provided corresponding sensors are installed in the locomotives and other consumers, to transmit information about the current speed, acceleration, temperature and energy consumption of the driving motor or the energy consumption of stationary consumers and the like to the control unit.

Figure 4:
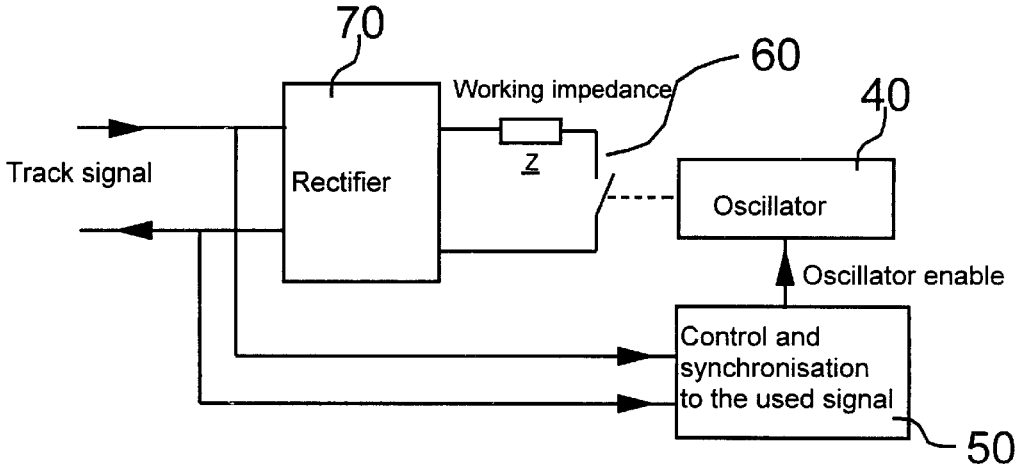
FIG. 4 shows a block diagram of a consumer adapted to perform the inventional method.

According to FIG. 4, a 1 MHz oscillator 40 is provided in consumer 20. The oscillator receives an oscillation enable signal from a scanning device 50 which scans the track signal and produces a synchronising signal to the predefined track signal period used. In this example, this period is the second half of the zero bits in the data packet following the data packet addressed to the consumer 20. Upon receipt of the oscillator enable signal, the oscillator 40 drives an otherwise open transistor switch 60 with 1 MHz.

The switch 60 is connected to the track in series via a working impedance Z. In the diagram, the impedance is provided behind a rectifier 70 which serves to supply energy to the consumer 20 as in known in the art. The series circuit of impedance Z and switch 60 can also be directly connected to the track. In the example shown in FIG. 4, the track voltage is superimposed by means of a current modulation with the return or feedback signal. This solution is technically simple and space-saving. The aforementioned necessary high impedance of a non-sending consumer for the return signal frequency is guaranteed by the inherent hardware of the consumer which is realized when switch 60 is open, i.e. disabled.

Figure 5:
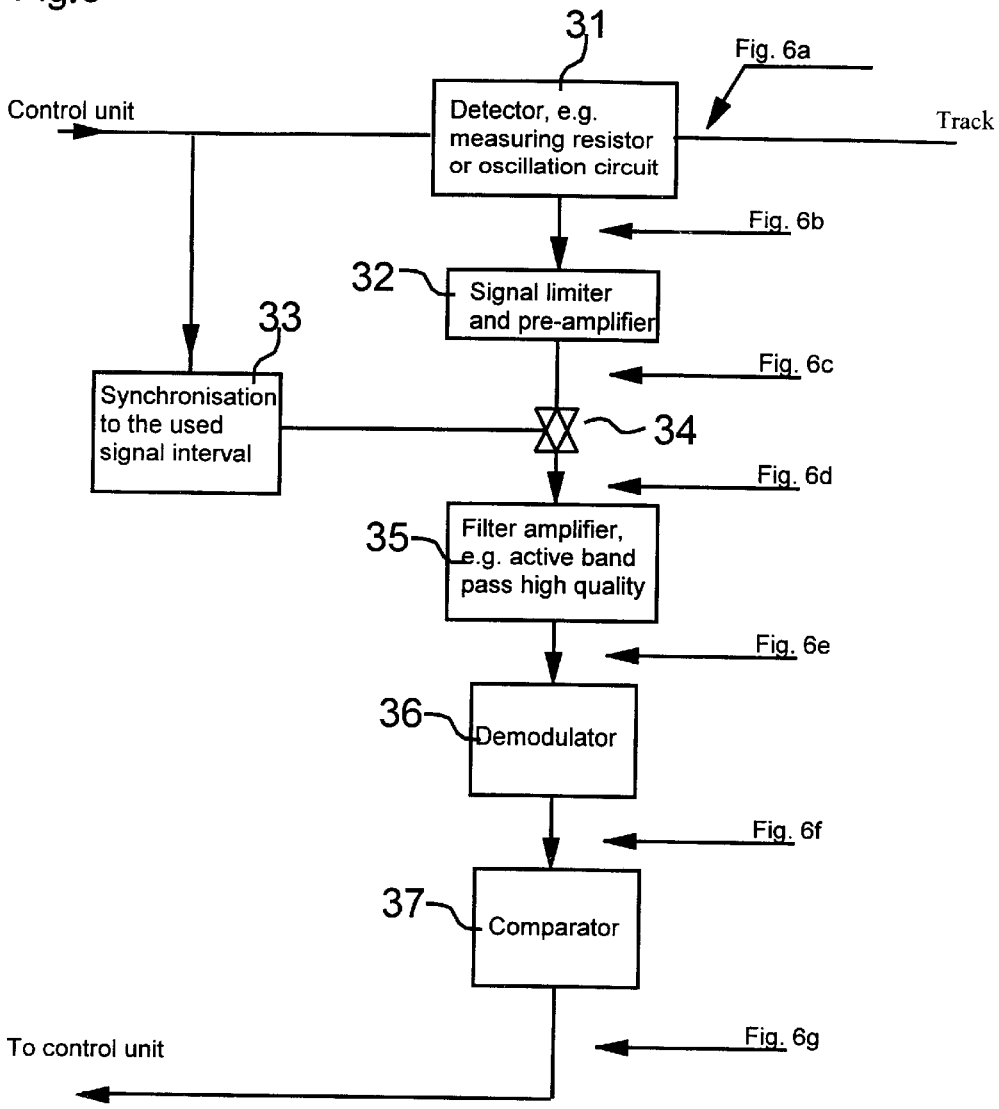
FIG. 5 is a block diagram showing an evaluation means according to an embodiment of the invention.
Figure 6A:
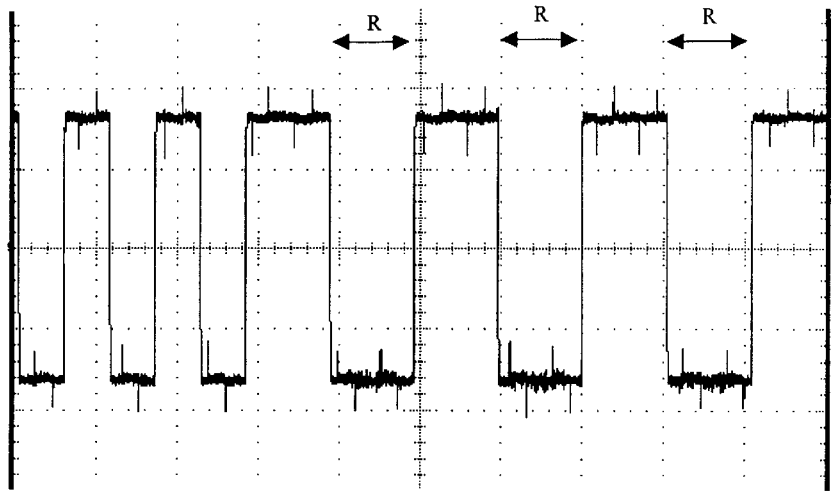
FIG. 6 shows diagrams of signals occurring at several points in the block diagram of FIG. 5.
Figure 6B:
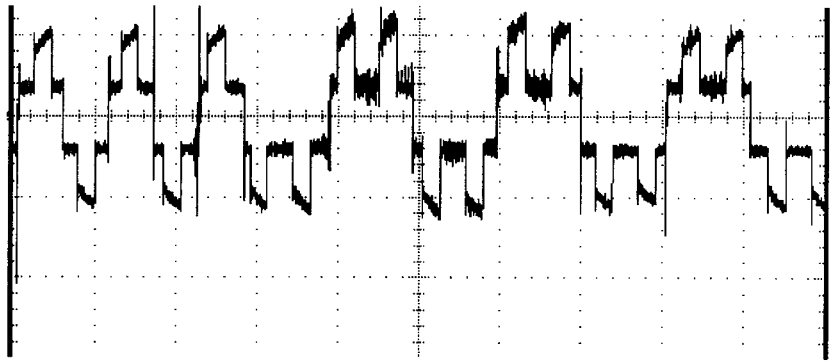

According to FIG. 5, the evaluation means 30 includes a detector 31 in the power circuit, which is supplied with the track signal. The square wave signal according to FIG. 1 generated by the control unit is represented in FIG. 6*a* and indicated in FIG. 5. The track signal exhibits a number of signal distortions and interference as explained above, as well as a possibly existing return or feedback signal. In FIG. 6*a*, the return signal is located in the signal edge free periods between alternating polarities marked R of the modulated control voltage from the control unit 10. The detector 31 obtains a detection signal from the track signal according to FIG. 6*b*. A subsequent signal limiting and pre-amplifying circuit 32 provides the normalized detection signal according to FIG. 6*c*, in which the return signal already occurs more clearly.

Figure 6C:
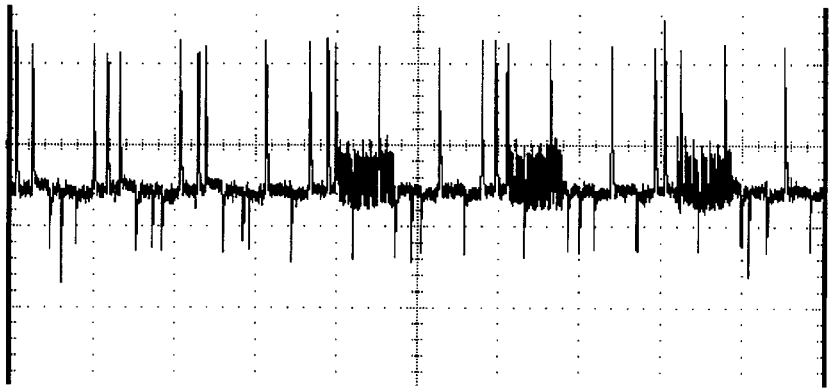
Figure 6D:
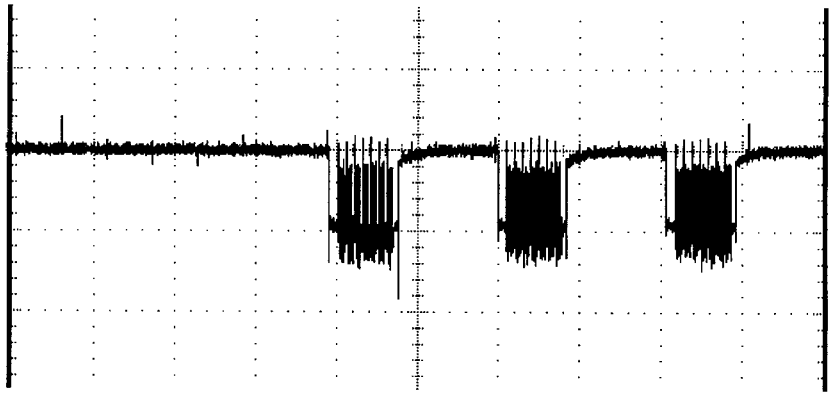
Figure 6E:
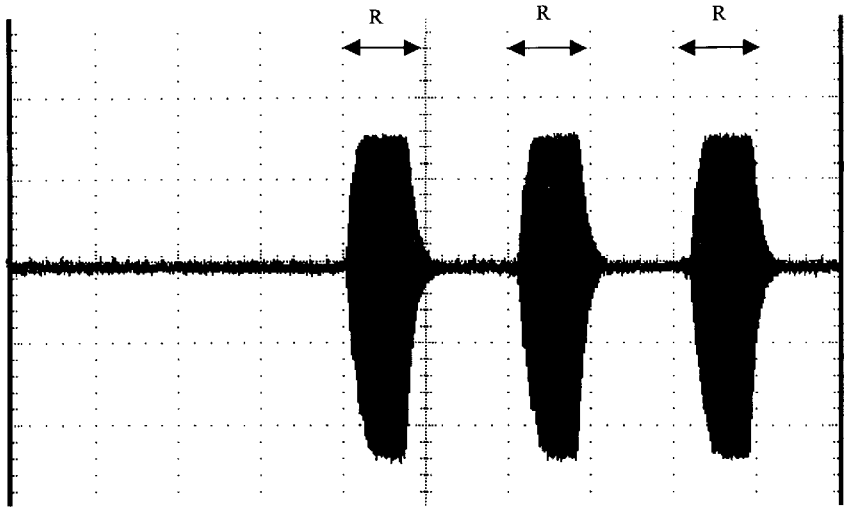
Figure 6F:
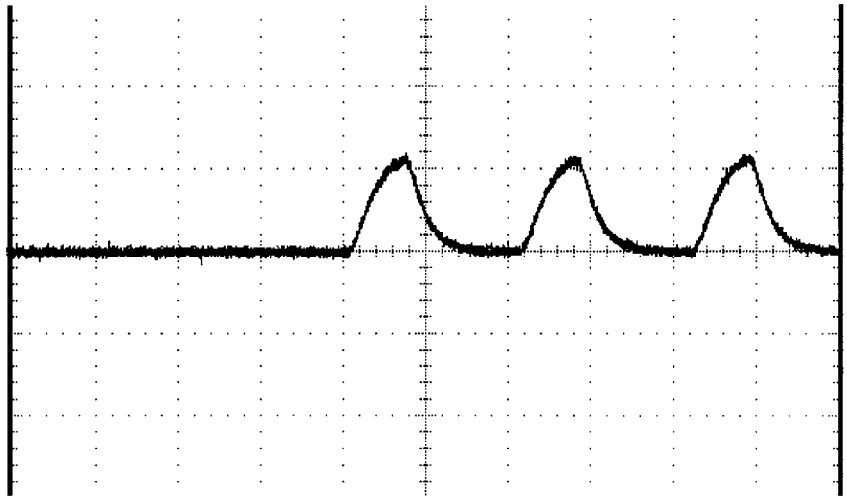
Figure 6G:
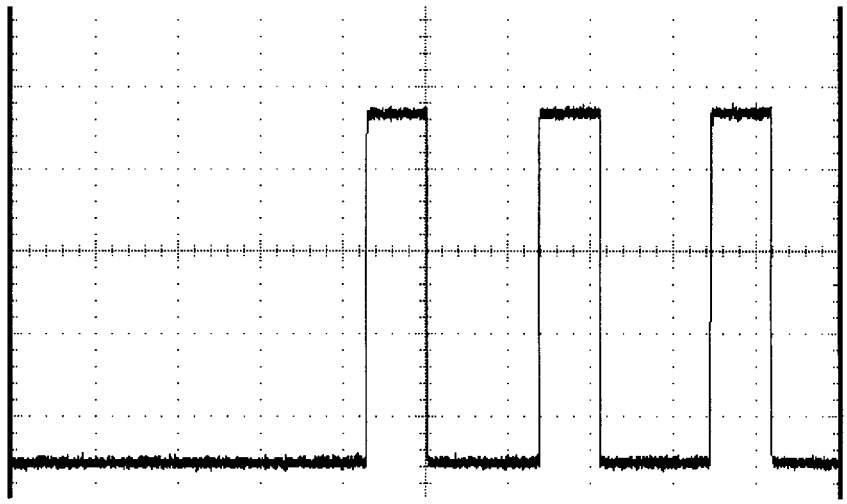

A gate switch 34 connected to the signal limiting and pre-amplifying circuit 32 is provided in the form of an analogue switch, and filters out the time periods R used for the return signal from the normalized detection signal according to FIG. 6*c*. For this. the control contact of the gate switch 34 receives a synchronisation signal from a synchronisation device 33. The synchronisation device 33 has the same principle construction as a sensor device 50 and receives the control signal sent to the track by the control unit 10 according to FIG. 1. Alternatively, the track signal according to FIG. 6*a* can also be sensed by the synchronisation device 33. As a result of this synchronisation, it is ensured that a filter amplifier 35, here in the form of a high quality active band pass, which is tuned to 1 MHz, receives the reduced signal according to FIG. 6*d*. The output signal of the filter amplifier 35 according to FIG. 6*e* is demodulated in a demodulator 36. The demodulated signal according to FIG. 6*f* is compared in a comparator 37 with a threshold value and the output signal according to FIG. 6*g* is supplied to the control unit 10.

Figure 7:
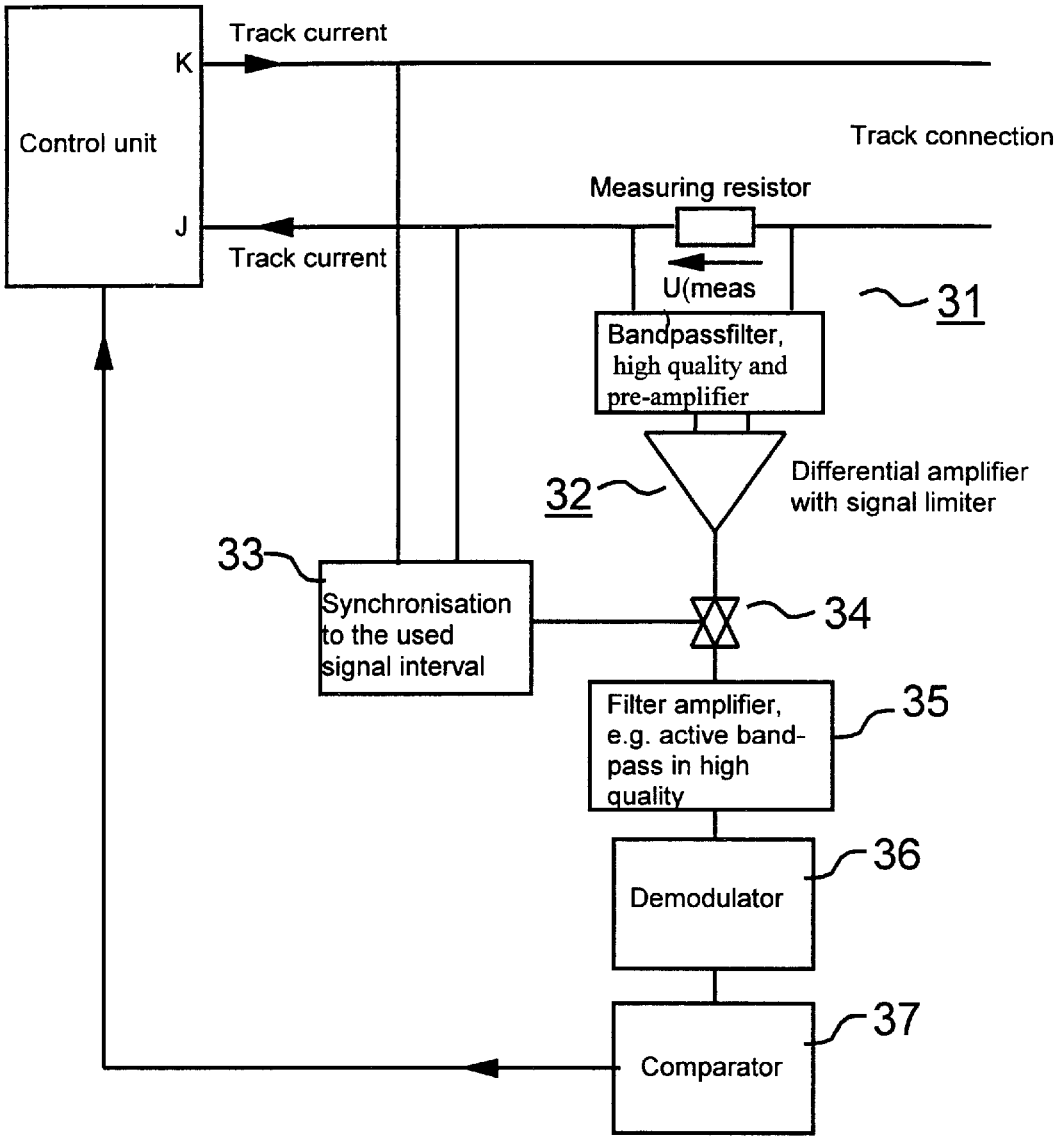
FIG. 7 shows an example of a detection circuit to be used in the embodiment of FIG. 5.

FIG. 7 shows a preferred embodiment for the detector 31, according to which a measuring resistance is provided in a connection line from the control unit 10 to the track. The measuring resistance converts the existing track signal with or without superimposed return signal to a proportional voltage. The voltage measured over the measuring resistance is pre-filtered in a band pass and supplied to the signal limiting and pre-amplifying circuit 32, which has been provided. as a differential amplifier. Otherwise, FIG. 7 corresponds to FIG. 5.

Figure 8:
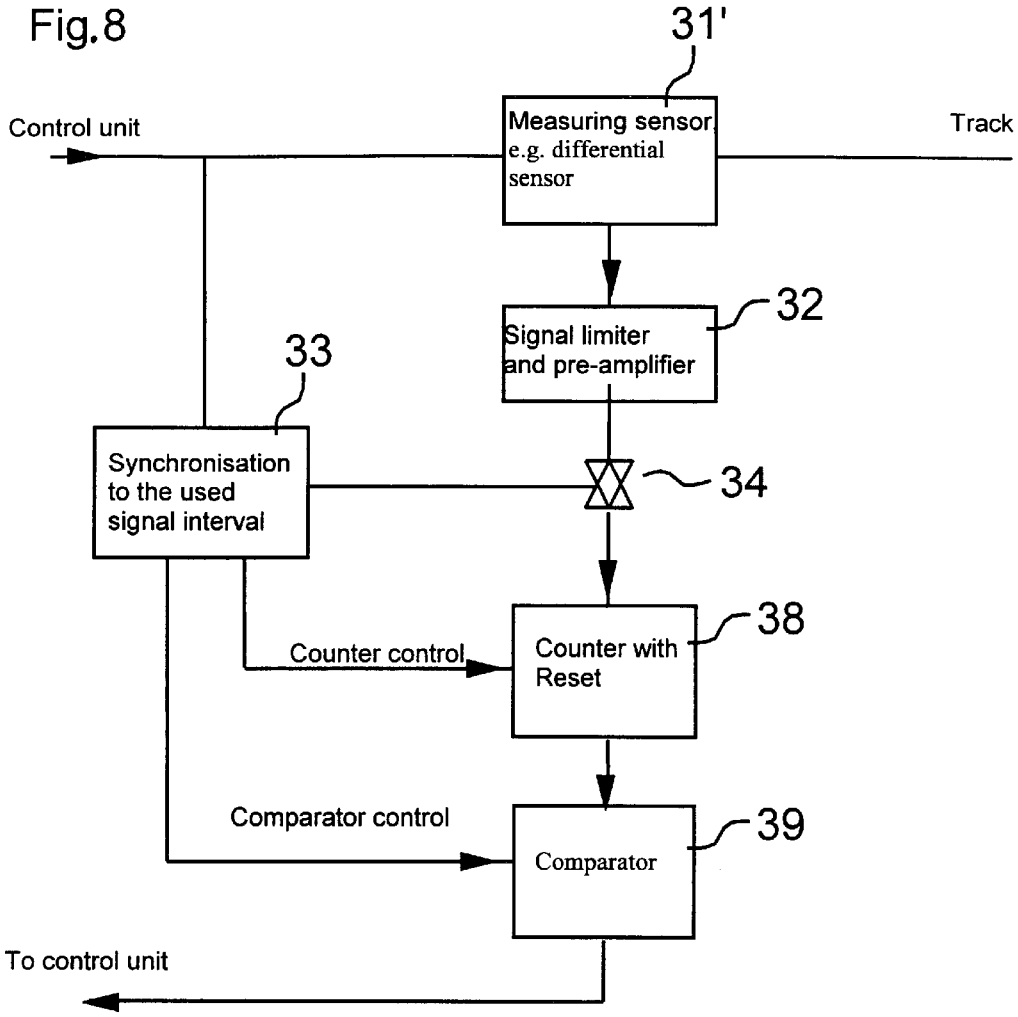
FIG. 8 shows a block diagram for another example of an evaluation means according to the invention.

FIG. 8 shows an alternative in which a detector 31' is a measuring sensor which, for example, contains a differentiator which converts the square wave return signal contained in the detected signal into a pulse series. A counter 38 synchronized to the signal periods R by the switch 34 counts the pulses in each time period R. Furthermore, the counter 38 is controlled by the synchronisation device 33 such that it is set to zero outside the time periods R, and counts the pulses during the time period R. For this purpose a gate switch is used. Apart from the pulse series resulting from the return signal, the counted pulses can also be various interference pulses. As a consequence of the predefined high frequency of the return signal's pulse series, these interference pulses, however, can be neglected in case of a sufficiently high count value. In this way, if the counter has counted, for example, up to 64 pulses, it can reliably be concluded that the counted pulses mainly result from the return signal and are not caused by interference and other sporadic signal distortions. Besides, considerably lower frequencies for the return signal are also sufficient to "lift" the count value resulting from the return signal above contributions of the interference signals in the overall count value.

A subsequent digital comparator 39 compares the count value of detector 30 with a set point value at the end of the time period R. If the count value exceeds the set point value, the comparator 39 generates a signal which represents a detected return signal during the time period R. The comparison control in the example is performed such that a possible detected return signal is transmitted to the control unit as long as the comparison control no longer transmits a release signal to the comparator 39.

As another alternative, it is also conceivable not to use a high frequency square wave modulation as return signal according to FIG. 4. Instead, a correspondingly high frequency pulse series generated by the consumer as return or feed back signal can be directly coupled to the track and then detected using principle of FIG. 8.

In the implemented embodiments the following hardware components and parameters have been used:

Control unit 10: LZ100 with an amplifier LV101, both of Lenz Elektronik GmbH;

Decoder 20: LE103XF of Lenz Elektronik GmbH;

Transistor switch 60: PMBF170 of Philips;

Gate switch 34: CD4066;

Comparator 37: LM393;

Counter 38: 74HC393;

Value of impedance Z=330 Ohm, and

Value of measuring resistance of detector 31=0,15 Ohm.

While there has been shown and described what are at present considered the preferred embodiment of the invention, it will be obvious to those skilled in the art that various changes and modifications can be made therein without departing from the scope of the invention defined by the appended claims.

I claim:

1. A method for digital control of electrical consumers in a model railway, wherein the power for the consumers is supplied over the track in the form of a square wave voltage signal which is at least one of frequency and pulse width modulated according to digital control information for the consumers generated by a central control unit of the model railway, wherein a consumer, after having received a control information addressed to said consumer, applies a high frequency return signal to the track having a predetermined frequency which is higher than the frequency of the modulated square wave voltage and not below 300 kHz, and wherein this return signal is detected by synchronising the detection to the square wave voltage such that the return signal is detected in periods of the square wave voltage signal which are free of signal edges and such that detector means for detecting said high frequency return signal do not receive and respond to signal portions containing signal edges of the modulated square wave voltage signal.

2. The method according to claim 1, wherein the return signal is detected in signal edge free periods which, due to the modulation, are relatively long periods, such as the second signal half of a zero information when using NMRA DCC electrical standard of 1995 and the NMRA DCC communications standard of 1995.

3. The method according to claim 1, wherein the higher frequency return signal is applied to the track and synchronized with the square wave voltage, and is in said signal edge free periods of the square wave voltage signal.

4. The method according to claim 3, wherein the higher frequency return signal is applied to the track in a data packet which follows the data packet of the received control information.

5. The method according to claim 1, wherein the return signal is superimposed to the track signal by means of a current modulation.

6. The method according to claim 1, wherein the return signal is applied in the form of an oscillation and wherein the return signal is detected by detecting its frequency.

7. The method according to claim 1, wherein the return signal is applied in the form of a series of pulses and wherein the return signal is detected by counting a prescribed number of pulses.

8. The method according to claim 1, wherein the frequency of the high frequency return signal is 1 MHz or more.

9. A device for digital control of electrical consumers in a model railway, wherein the power for the consumers is supplied over the track in the form of a square wave voltage signal which is at least one of frequency and pulse width modulated according to digital control information for the consumers generated by a central control unit of the model railway, comprising:

means within a consumer for applying, after having received a control information addressed to said consumer, a high frequency return signal to the track, which return signal having a predetermined frequency which is higher than the frequency of the modulated square wave voltage and not below 300 kHz; and means for detecting this return signal by synchronizing the detection to the square wave voltage such that the return signal is detected in periods of the square wave voltage signal which are free of signal edges such that said means for detecting the high frequency return signal do not receive and respond to signal portions containing signal edges of the modulated square wave voltage signal.

10. The device according to claim 9, wherein said means for applying said return signal comprise detecting means for detecting the square wave voltage signal and generating means for generating said return signal, said generating means being activated by a synchronisation signal derived from the detector signal provided by the detecting means for the square wave voltage, and wherein said means for detecting said return signal comprise an evaluation means connected to the track and to the central control unit of the model railway.

11. The device according to claim 10, wherein said evaluation means is controlled by a detection means which detects the modulated square wave signal on the track.

12. The device according to claim 9, wherein said means for detecting said return signal is controlled by means of a synchronisation signal from the central control unit, which synchronisation signal is synchronized with the modulated square wave signal.

13. The device according to claim 9, wherein said means for applying said return signal has an oscillator set to the frequency of the high frequency return signal which superimposes the return signal to the track only in the signal edge free periods of the square wave signal.

14. The device according to claim 9, wherein said means for applying said return signal within a consumer has a series connection of a working impedance and a switch means which is activated by an oscillator and is connected to the track.

15. The device according to claim 9, wherein said means for detecting the return signal has a filter amplifier tuned to the frequency of the return signal, said filter amplifier being connected to the track via a detector for the square wave signal.

16. The device according to claim 9, wherein said means for detecting the return signal has a resettable counter which is connected to the track via a detector for the square wave signal.

17. The device according to claim 9, wherein said means for detecting the return signal comprise a detector for the square wave signal which has a measuring resistance or oscillating circuit.

18. The device according to claim 9, wherein said means for detecting the return signal comprise a measuring sensor for the square wave signal which has a differentiator.

19. The device according to claim 17, wherein a signal limiting and pre-amplifying circuit is connected to the measuring resistance or oscillating circuit.

20. The device according to claim 18, wherein a signal limiting and pre-amplifying circuit is connected to the differentiator.

21. A method for digital control of electrical consumers in a model railway, wherein the power for the consumers is supplied over the track in the form of a square wave voltage signal which is at least one of frequency and pulse width modulated according to digital control information for the consumers generated by a central control unit of the model railway, wherein a consumer, after having received a control information addressed to said consumer, applies a high frequency return signal in the form of an oscillation to the track having a predetermined frequency which is higher than the frequency of the modulated square wave voltage and not below 300 kHz, and wherein this return signal is detected by detecting the frequency of said high frequency return signal and by synchronising the detection to the square wave voltage such that the return signal is detected in periods of the square wave voltage signal which are free of signal edges and such that detector means for detecting said high frequency return signal do not receive and respond to signal portions containing signal edges of the modulated square wave voltage signal.

22. A method for digital control of electrical consumers in a model railway, wherein the power for the consumers is supplied over the track in the form of a square wave voltage signal which is at least one of frequency and pulse width modulated according to digital control information for the consumers generated by a central control unit of the model railway, wherein a consumer, after having received a control information addressed to said consumer, applies a high frequency return signal in the form of a series of pulses to the track having a predetermined frequency which is higher than the frequency of the modulated square wave voltage and not below 300 kHz, and wherein this return signal is detected by counting a prescribed number of the pulses and by synchronising the detection to the square wave voltage such that the return signal is detected in periods of the square wave voltage signal which are free of signal edges and such that detector means for detecting said high frequency return signal do not receive and respond to signal portions containing signal edges of the modulated square wave voltage signal.

* * * * *

UNITED STATES PATENT AND TRADEMARK OFFICE

CERTIFICATE OF CORRECTION

PATENT NO. : 6,494,410 B2
DATED : December 17, 2002
INVENTOR(S) : Lenz

It is certified that error appears in the above-identified patent and that said Letters Patent is hereby corrected as shown below:

Column 3,
Line 10, insert period -- . -- between "off In" so it reads -- off. In --

Column 7,
Line 24, delete "." from "provided. as" so it reads -- provided as --

Signed and Sealed this

Twenty-sixth Day of August, 2003

JAMES E. ROGAN
*Director of the United States Patent and Trademark Office*